US005445368A

United States Patent [19]

Lester et al.

[11] Patent Number: 5,445,368

[45] Date of Patent: Aug. 29, 1995

[54] APPARATUS AND METHOD FOR FORMING COLLATIONS OF TWO DIFFERENT SIZE DOCUMENTS

[75] Inventors: Malcolm F. Lester, Braintree, United Kingdom; William J. Wright, Killingworth, Conn.

[73] Assignee: Pitney Bowes Inc., Stamford, Conn.

[21] Appl. No.: 141,763

[22] Filed: Oct. 27, 1993

[51] Int. Cl.[6] ..... B65H 43/00; B65H 9/04

[52] U.S. Cl. ..... 270/59; 271/303; 271/242; 271/245

[58] Field of Search ..... 270/32, 45, 46, 51, 270/59, 58; 271/300, 302, 303, 242, 245

[56] References Cited

U.S. PATENT DOCUMENTS

| | | | |
|---|---|---|---|
| 269,159 | 12/1882 | Crowell | 270/59 |
| 3,271,023 | 9/1966 | Disbrow et al. | 270/58 |
| 4,354,671 | 10/1982 | Bergland | 270/58 |
| 4,355,795 | 10/1982 | Bergland | 270/58 |
| 4,621,966 | 11/1986 | Luperti et al. . | |
| 4,640,506 | 2/1987 | Luperti et al. | 271/212 |
| 4,799,663 | 1/1989 | Golicz | 271/199 |
| 4,805,891 | 2/1989 | Luperti et al. | 271/212 |
| 4,898,570 | 2/1990 | Luperti et al. | 270/46 X |
| 5,083,769 | 1/1992 | Young, Jr. | 270/58 X |
| 5,123,639 | 6/1992 | Edwards . | |
| 5,125,633 | 6/1992 | Fecker et al. | 270/45 X |
| 5,129,641 | 7/1992 | Long . | |
| 5,178,379 | 1/1993 | Edwards et al. . | |
| 5,203,551 | 4/1993 | Lowell et al. . | |
| 5,211,387 | 5/1993 | Lloyd et al. | 271/111 |
| 5,288,063 | 2/1994 | Lunt | 270/59 X |
| 5,289,251 | 2/1994 | Mandel et al. | 270/59 X |

*Primary Examiner*—John E. Ryznic

*Attorney, Agent, or Firm*—Charles R. Malandra, Jr.; Melvin J. Scolnick

[57] ABSTRACT

A method and apparatus for accumulating two different size documents to form a collation, comprises a first accumulator pocket having first structure for individually transporting, stacking and registering at least one smaller one and one larger one of the documents to form a first collation of the smaller and larger documents. A second accumulator pocket is superposed over the first accumulator pocket, the second accumulator pocket having second structure for individually transporting, stacking and registering at least one smaller one and one larger one of the documents to form a second collation of the smaller and larger documents. Diverting structure is situated upstream of the first and second pockets for diverting the smaller and larger documents to one of the first and second accumulator pockets. Each of the first and second accumulator pockets includes a first ramp guide block defining an upstream end of a first stacking area for smaller ones of the documents and a second ramp guide block defining an upstream end of a second stacking area for larger ones of the documents.

6 Claims, 8 Drawing Sheets

APPARATUS AND METHOD FOR FORMING COLLATIONS OF TWO DIFFERENT SIZE DOCUMENTS

FIELD OF THE INVENTION

The invention disclosed herein relates generally to apparatus for processing sheets and more particularly to with apparatus for accumulating and folding documents.

RELATED APPLICATIONS

The present application is related to U.S. application Ser. No. 08/141,764, filed concurrently herewith.

BACKGROUND OF THE INVENTION

Collating machines are frequently used in line with other paper handling equipment as a means of assembling a plurality of sheets of paper into a particular, desired packet or collation prior to further processing, which may include additional collating, folding and inserting. In a typical paper handling sequence involving an initial output consisting of a plurality of sheets of paper, to be later combined with subsequent output from other sheet feeding devices situated downstream, the initial output is fed from a stack, or a web supply, seriatim to the collating machine, which collates the output into the desired packets, citijet in the same or reverse order in which the sheets are fed to tile collator. Each packet may then be folded, stitched or subsequently combined with other output From document feeding devices located downstream thereof and ultimately inserted into a mailing envelope.

U.S. Pat. Nos. 4,640,506 and 4,805,891 disclose collating machines incorporating respectively removable and moveable reverse order stacking devices for stacking sheets of paper being fed seriatim thereto from a singulating feeder in the same or reverse order as said sheets appear in said singulating feeder.

U.S. Pat. No. 5,083,769 discloses a dual collating machine having upper and lower collating structures for alternately stacking sheets into collations. The dual collating machine includes a diverting means for diverting sheets conveyed along a single paper path into the upper or lower collating structure, and a funnel means for returning the collations to a single paper path.

Heretofore, collating machines, such as the aforementioned machines, have been limited to forming a collation of sheets having the same size. Generally, collating machines are configured to achieve a lead edge justification of the sheets and prevent skewing to the sheets in the collation. The aforementioned collating machines rely on its side guides, transport system and stops to deskew the sheets of the collation and achieve lead edge justification. Heretofore, collating machines have been used to form collations of same size documents. If different size documents were collated, the side guides would not control the skewing of the smaller documents being conveyed.

There is now an interest in forming collations of documents of more than one size and nesting the smaller documents within the fold of the larger documents. For example, it is desired that a full size insurance statement (or collation of statements) be folded around a smaller size check that is to be mailed with the statement. The typical collating machines and folders do not easily provide for such special processing because of the problem of controlling the smaller document.

It is an object of the present invention to provide an improvement to collating machines that will allow the collating machines to form collations of different size documents.

SUMMARY OF THE INVENTION

The present invention provides a collating machine which forms collations of two different size documents. In accordance with the present invention, a method of forming a collation of at least two different size documents comprises the steps of: feeding at least one smaller size document into a collating apparatus; holding the smaller size document in the collating apparatus lead edge justified; feeding at least one larger size document into the collating apparatus; holding the larger size document in the collating machine superposed on the smaller document with lead edge justified to form a collation; and feeding the collation out of the collating apparatus for further processing while maintaining the justified lead edge of the collation. The method comprises the further step of nesting the smaller document into the first fold of the larger document.

In accordance with the present invention an apparatus for accumulating two different size documents to form a collation, comprises a first ramp guide block defining an upstream end of a first stacking area for smaller ones of the documents; and a second ramp guide block defining an upstream end of a second stacking area for larger ones of the documents. The apparatus includes means for transporting both the smaller and larger of the documents over the first and second ramp guide blocks, and means for registering the lead edge of both the smaller and larger ones of the documents after the documents have been transported over the first and second ramp guide means. The transporting means include at east two lower, endless, flat belts that are laterally spaced a distance approximately equal to the width of the smaller ones of the documents. The flat belts are opposed from above by a plurality of longitudinally spaced balls that are suspended above each of the flat belts by a housing wherein the longitudinally spaced balls provide a normal force against the smaller and larger ones of the documents that are transported over the first and second ramp guide means.

The transporting means further includes at least one upper, endless, O-ring belt laterally spaced a between the flat belts, the lower flat belts and the upper O-ring belt each having an upper and lower reach. The lower reach of the upper O-ring bell is situated approximately on the horizontal plane of the upper reach of the lower flat belts to thereby frictionally engage both the smaller and larger ones of the documents as the documents are transported over the first and second ramp guide means.

In the preferred embodiment of the present invention a bi-level accumulating apparatus for accumulating two different size documents to form a collation, comprises a first accumulator pocket having first means for individually transporting, stacking and registering at least one smaller one and one larger one of the documents to form a first collation of the smaller and larger documents. The apparatus further includes a second accumulator pocket superposed over the first accumulator pocket, the second accumulator pocket having second means for individually transporting, stacking and registering at least one smaller one and one larger one of the documents to form a second collation of the smaller and larger documents. Diverting means are situated upstream of the first and second pockets for diverting the smaller and larger documents to one of the first and second accumulator pockets. Each of the first and second accumulator pockets includes a first ramp guide block defining an upstream end of a first stacking area for smaller ones of the documents and a second ramp guide block defining an upstream end of a second stacking area for larger ones of the documents.

U.S. Pat. No. 5,083,769 discloses a

DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE PRESENT INVENTION

Figure 1:
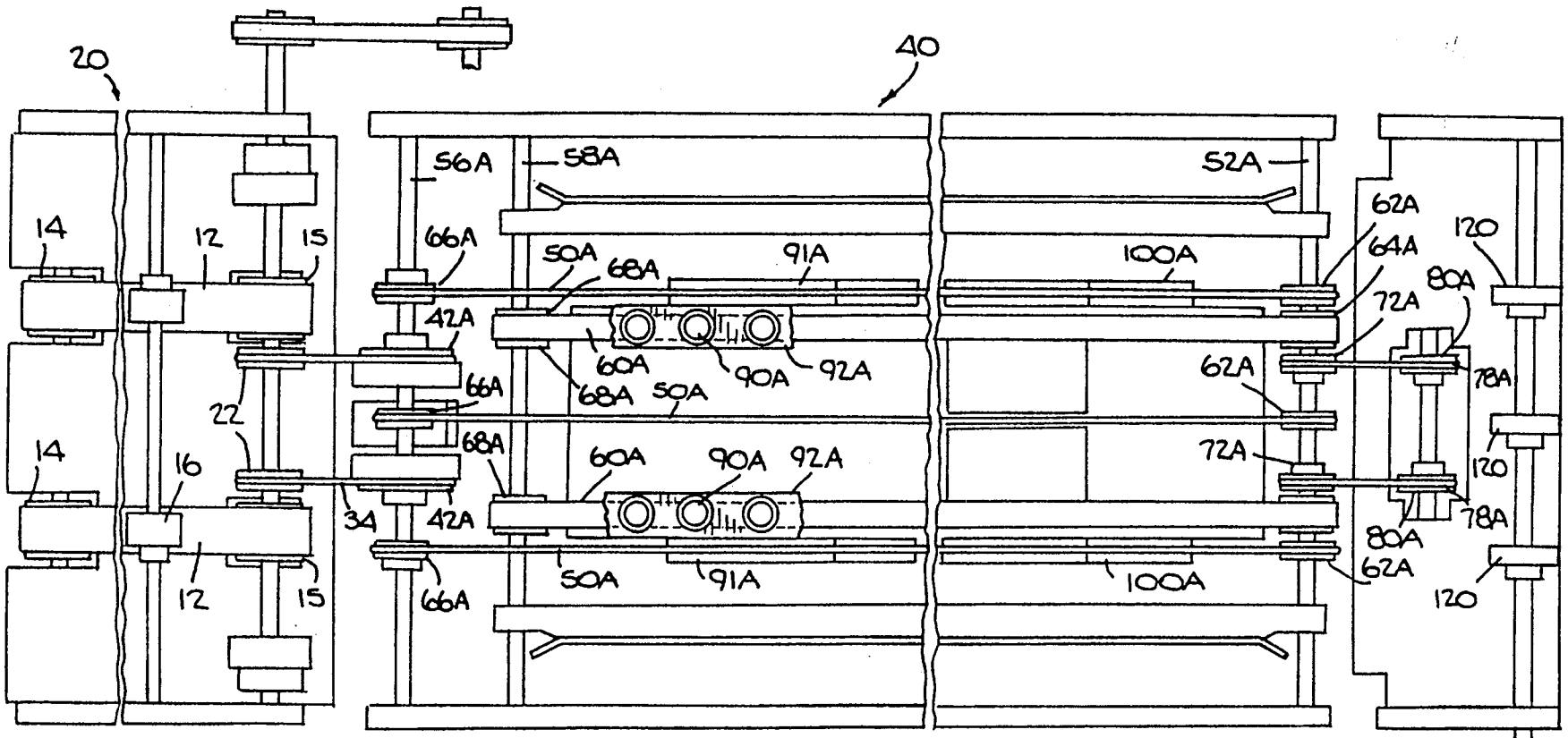
FIG. 1 is a top plan view of a dual in-line collating machine in accordance with the present invention.

In describing the preferred embodiment of the present invention, reference is made to U.S. Pat. Nos. 4,640,506 and 4,805,891, both assigned to the assignee of the present invention, and incorporated herein for showing the capability of stacking sheets of paper in the same or reverse order in which they are fed to the collating magazine.

Referring now to the drawings, the preferred embodiment of the present invention is shown wherein a system, generally designated 10, for nesting smaller documents into larger documents includes feeding apparatus (not shown), a transport 20, a dual level accumulator or collator, generally designated 40, and a folder 130. System 10 processes two different size documents fed from one feeder or separate feeders (not shown), forms a collation of the documents and nests the smaller document in tile larger document for further processing, for example by an inserting machine (not shown) .

Figure 2:
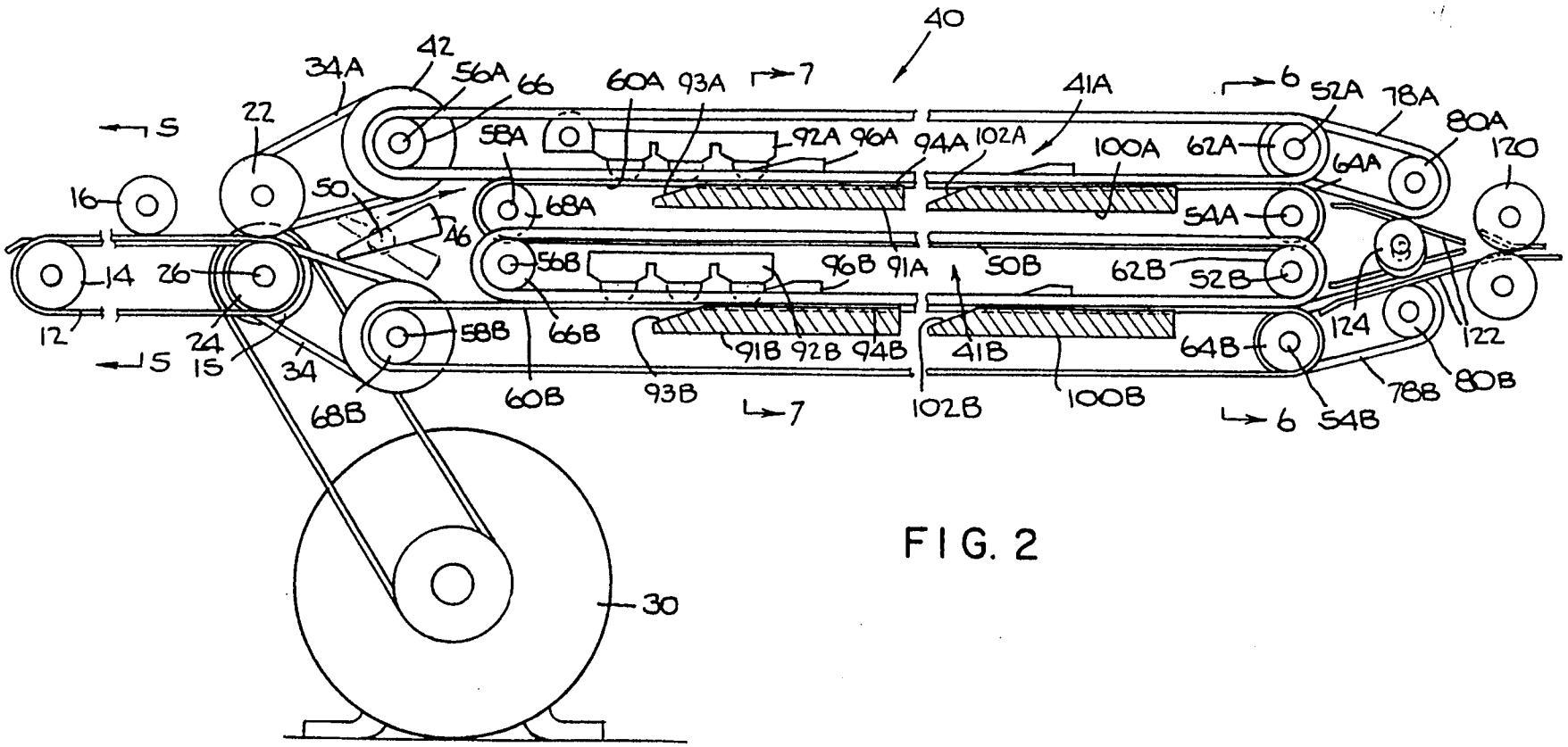
FIG. 2 is a side elevational view of the collating machine of FIG. 1.
Figure 3:
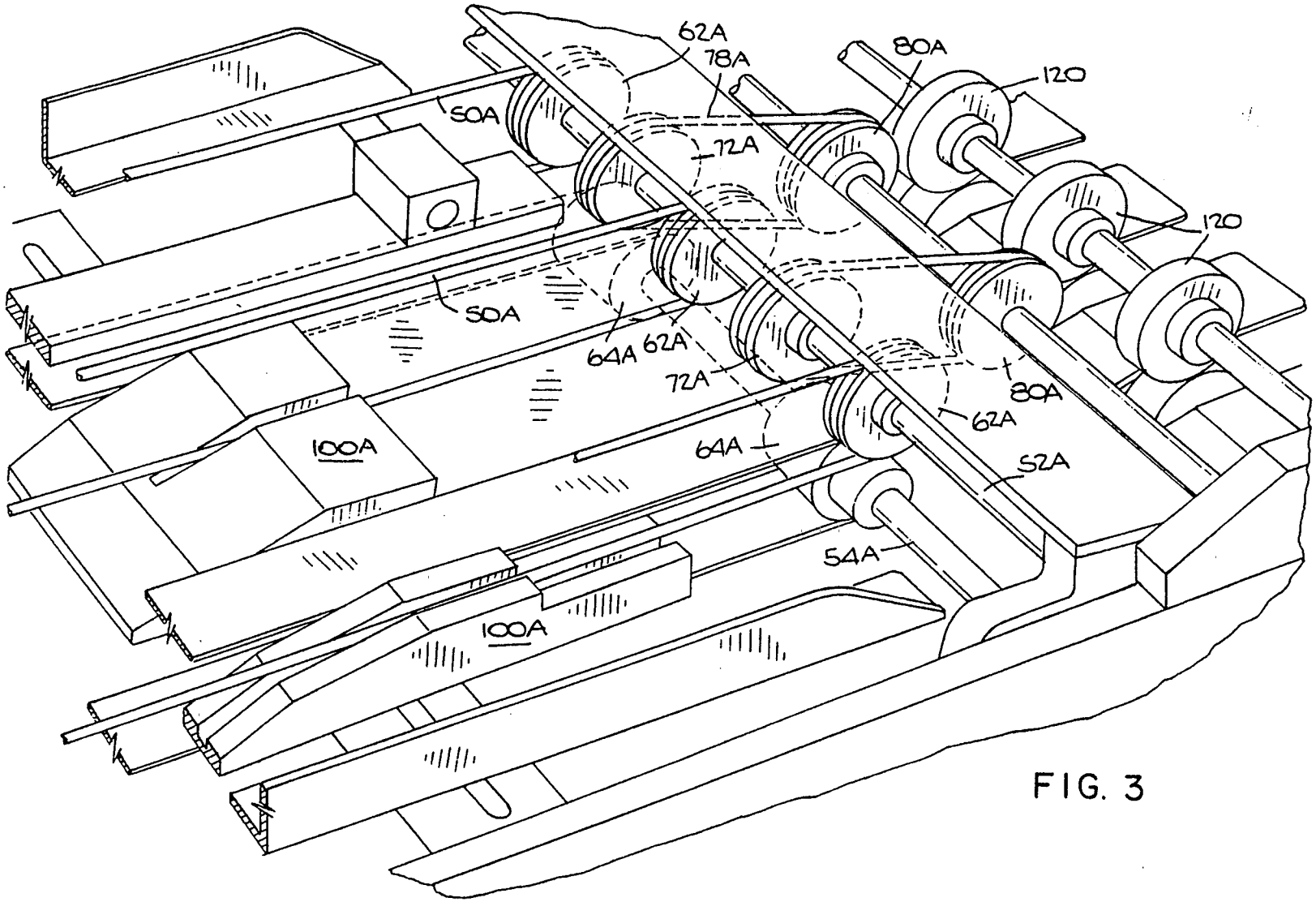
FIG. 3 is a perspective view of the downstream end of the collating machine of FIG. 1.
Figure 5:
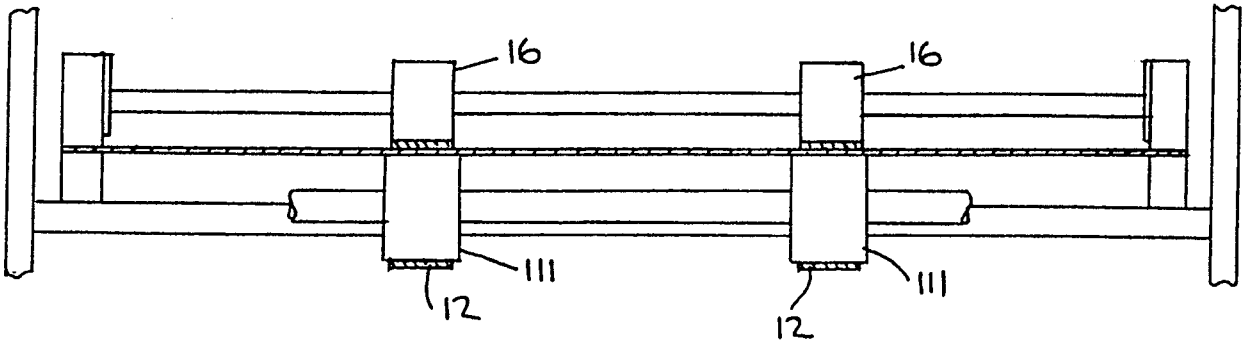
FIG. 5 is a sectional view taken on the plane indicated by line 5—5 in FIG. 2.
Figure 4:
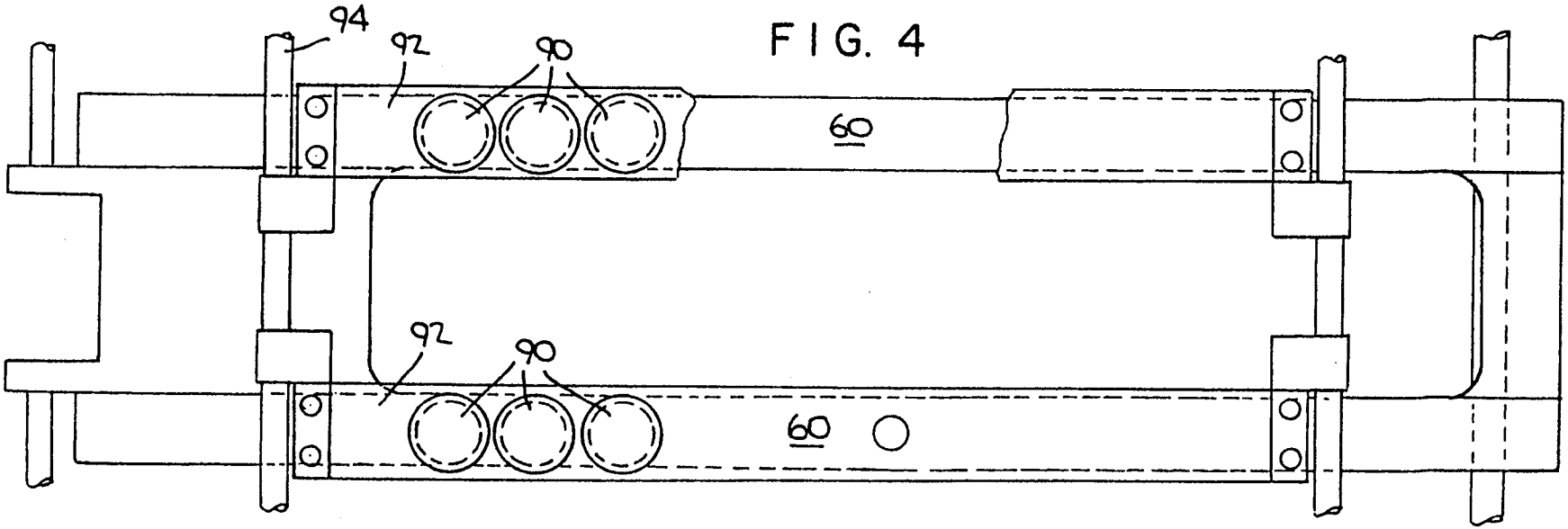
FIG. 4 is horizontal sectional view taken on the plane indicated by line 4—4 in FIG. 2.

Referring now to FIGS. 1, 2 and 5, transport 20 includes two endless, lower flat belts 12 which travel around pulleys 14 and 15. Each of belts 12 has an upper reach which is opposed by at least one biased, idler roller 16. The number of rollers opposing each belt depends on the length of transport 10 and size of the smallest document that will be handled by transport 20. The rollers opposing each belt are longitudinally spaced a distance that is less that the length of the smallest document to be transported. Rollers 16 and belts 12 are approximately one inch wide and have a relatively high coefficient of friction. This structure deters any skewing of the documents being transported and provides maximum control of the smaller documents that are transported to accumulator 40. At the downstream end of transport 20 a pair of upper and lower dual function pulley/rollers 22 and 24 are use to transport documents to accumulator 40 and to drive the belt and pulley system of accumulator 40, which is described below. In the preferred embodiment of the present invention, lower pulley/rollers 24 and pulleys 15 are fixed to drive shaft 26 which is coupled to a conventional pulley system coupled to motor 30. Upper pulley/rollers 22 are in turn conventionally driven, for example by gear drive.

Accumulator 40 is a dual pocket accumulator with identical upper and lower pockets, generally designated 41A and 41B respectively. Each of pockets 41A and 41B is capable of accumulating a one or more of the smaller documents in the order in which they are fed into the respective pocket, and accumulating one or more of the larger documents in the same or reverse order in which they are fed into the pocket. Like components in pockets 41A and 41B are designated with the same reference numeral with an additional reference of letters A or B for the upper or lower pocket respectively. Because the pockets are identically structured with like components having the same reference numerals, except for the A or B designated, the two sections will be described once without the A and B designations. It will be appreciated by those skilled in the art that an alternate embodiment (not shown) of the present invention comprises a single pocket accumulator.

Referring now to FIGS. 1 and 2, transport 20 is coupled to accumulator 40 by two pairs of upper and lower O-ring belts 34. Upper and lower belts 34 travel around pulley/rollers 22 and 24 respectively at one end and pulleys 42 and 44 at the other end. Between pulleys 42 and 44 there is a wedge-shaped deflector 46, which has a tapered end 48 facing transport 20. Deflector 46 is fixedly secured to a shaft 50 which pivots between two positions, as shown in FIG. 2. The pivoting motion of deflector 46 is controlled by a rotary solenoid (not shown) having an internal return spring. A more detailed description of the operational structure of deflector 46 is provided in U.S. Pat. No. 5,083,769, previously noted, which is hereby incorporated by reference.

Each of pockets 41A and 41B include a transport system which controls the movement of documents fed into accumulator 40. The accumulator transport system comprises three upper, endless O-ring belts 50 and two lower, endless flat belts 60. Flat belts 60 are each opposed by a set of longitudinally spaced steel balls 90 that rest against belts 60. Three pulleys 62 are rotatably mounted to shaft 52 while two idler pulleys 64 are rotatably mounted on shaft 54. Three pulleys 66 are secured to shaft 56 while two pulleys 68 are secured to shaft 58. Shafts 52, 54, 56 and 58 are rotatably mounted in the frame (not shown) of accumulator 40 in a conventional manner. O-ring belts 50 ape suspended on the pulleys 66 and 62. Flat belts 60 are suspended on pulleys 68 and 64.

Each set of steel balls 90 are suspended over a corresponding flat belt 60 from a housing 92 that is rigidly mounted to a bar 94 which is transversely mounted to a frame member (not shown) of accumulator 40. In the lower section of each housing 92 there are a plurality of holes 96 through which balls 90 protrude and rest against flat belts 60. Balls 90 are biased toward belts 60 by the weight of the balls. Balls 90 have room in housing 92 to move upward to handle different thickness of documents. In the preferred embodiment of the present invention, steel balls 90 are spaced approximately one and ¼ inches apart to deter skewing of the smaller documents. Rollers similar to rollers 16 in transport 20 may be used instead of steel balls 16 should more control of the smaller documents be desired.

Figure 6:
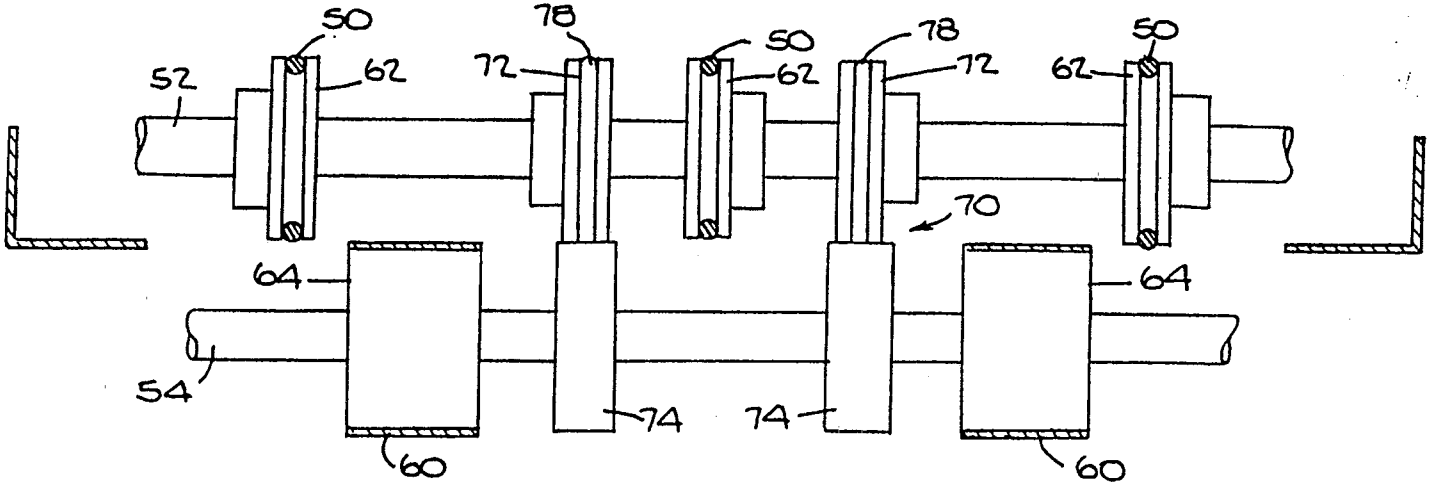
FIG. 6 is a sectional view taken on the plane indicated by line 6—6 in FIG. 2.

As best seen in FIG. 6, two exit roller pairs, generally designated 70 include upper idler rollers 72 which are rotatably mounted on shaft 52 and lower rollers 74 which are secured to shaft 54. In addition to transporting collations from accumulator 40, exit rollers 70 act as registration stops for sheets transported into accumulator 40. Each of upper exit rollers. 72 have a center groove by which it functions as a pulley over which O-ring belt 78 is suspended. Belts 78 are suspended downstream on pulleys 80. Shaft 54 is operatively coupled to a drive system, such as a clutch and brake system, (not shown) in a conventional manner whereby shaft 54, and thus lower exit rollers 74, rotate to transport collations from accumulator 40, but do not rotate when the collations are being formed.

Figure 7:
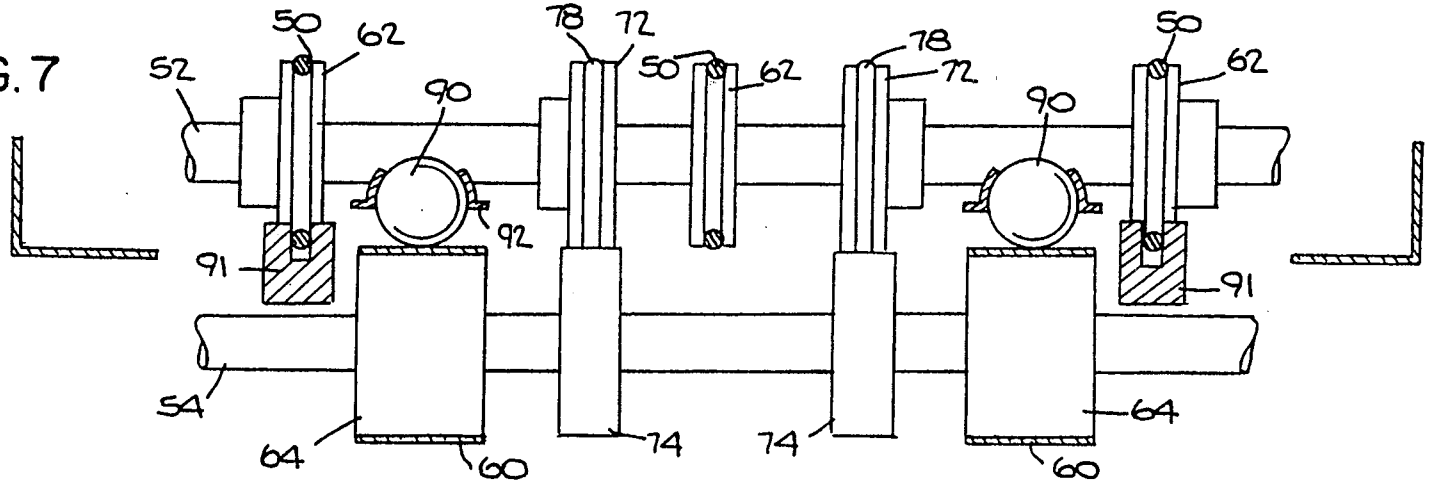
FIG. 7 is a sectional view taken on the plane indicated by line 7—7 in FIG. 2.
Figure 8:
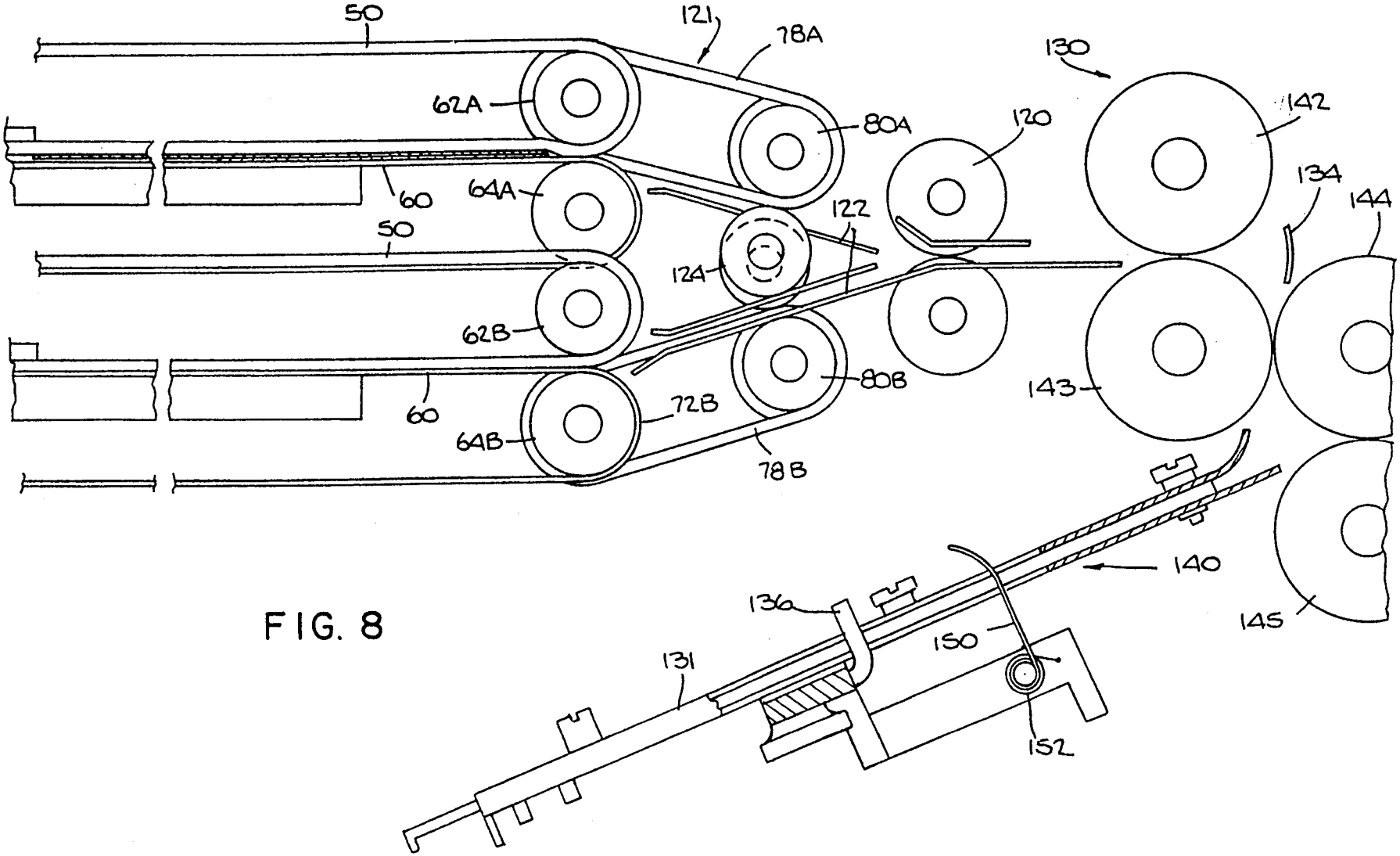
FIG. 8 is a side elevational view of the downstream end of the collating machine of FIG. 1 and a chute of a buckle chute folder.

As best shown in FIGS. 2 and 7, a pair of ramp guide blocks 91 are mounted to a transverse mounting arm not shown. Guide blocks 91 include a ramp section 93 on the upstream side for intercepting a leading end of sheets as they are transported individually by the transport system of accumulator 40. Each of guide blocks 91 includes an L-shaped portion on the downstream side defined by horizontal support surface 94 and vertical abutment surface 96. Guide blocks 91 are positioned in accumulator 40 such that vertical abutment surface 96 is a distance from exit rollers 70 approximately equal to, but not less than, the length of the larger document being processed in accumulator 40 A more detailed If) description of the slidable mounting and positioning of guide blocks 91 is provided in U.S. Pat. Nos. 4,805,891 and 5,083,769 which are hereby incorporated by reference.

In accordance with the present invention, a second pair of ramp guide blocks 100 are mounted to a second transverse mounting arm not shown. Each of guide blocks 91 has a shape similar to guide blocks 91, having a ramp section 102, a horizontal support surface 104 and a vertical abutment surface 106. Vertical abutment surface 106 may by smaller than vertical abutment surface 96 if accumulator 40 is handling a lessor number of small documents than larger documents. Suitable paper side guides 110 are secured to side frame members (not shown) on each side of accumulator 40 for guiding the sheets 6.

The collations fed from accumulator pockets 41A and 41B are funneled into a single paper path by an output transport 121 which includes exit belts 78 suspended over pulley/rollers 72 and 80. Guide plates 122 and idler roller 124 assist in the exiting of the collations. A pair of conveying rollers 120 are suitably journaled, supported and driven by a drive system (not shown) for conveying collations which are fed from the accumulator 40. Rollers 120 are positioned between accumulator 40 and folder 130 such that positive control of the smaller document(s) in the collation is maintained.

Figure 9:
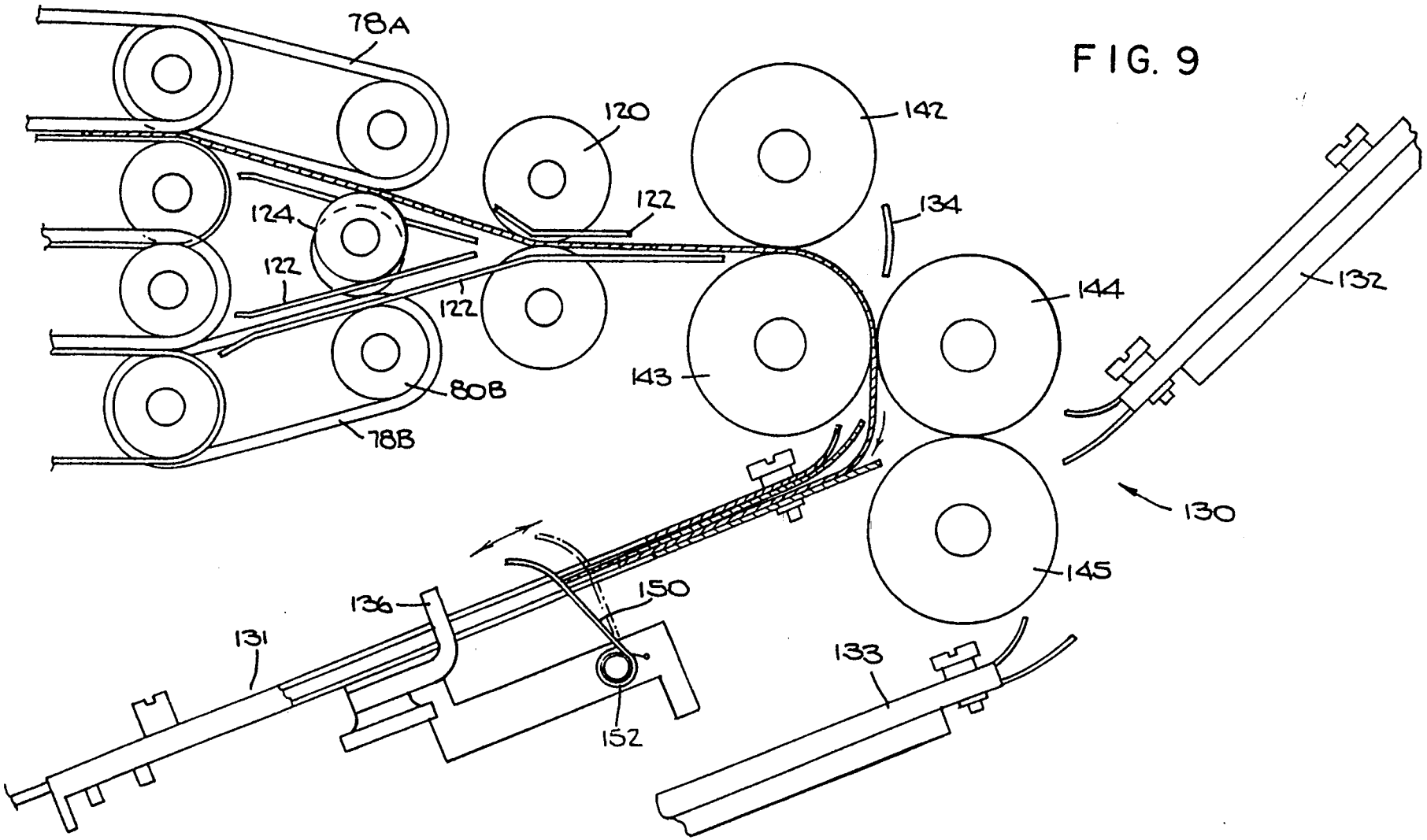
FIG. 9 is similar to FIG. 8 showing a small document and a full-sized document being conveyed out of the collating machine into the folder.
Figure 10:
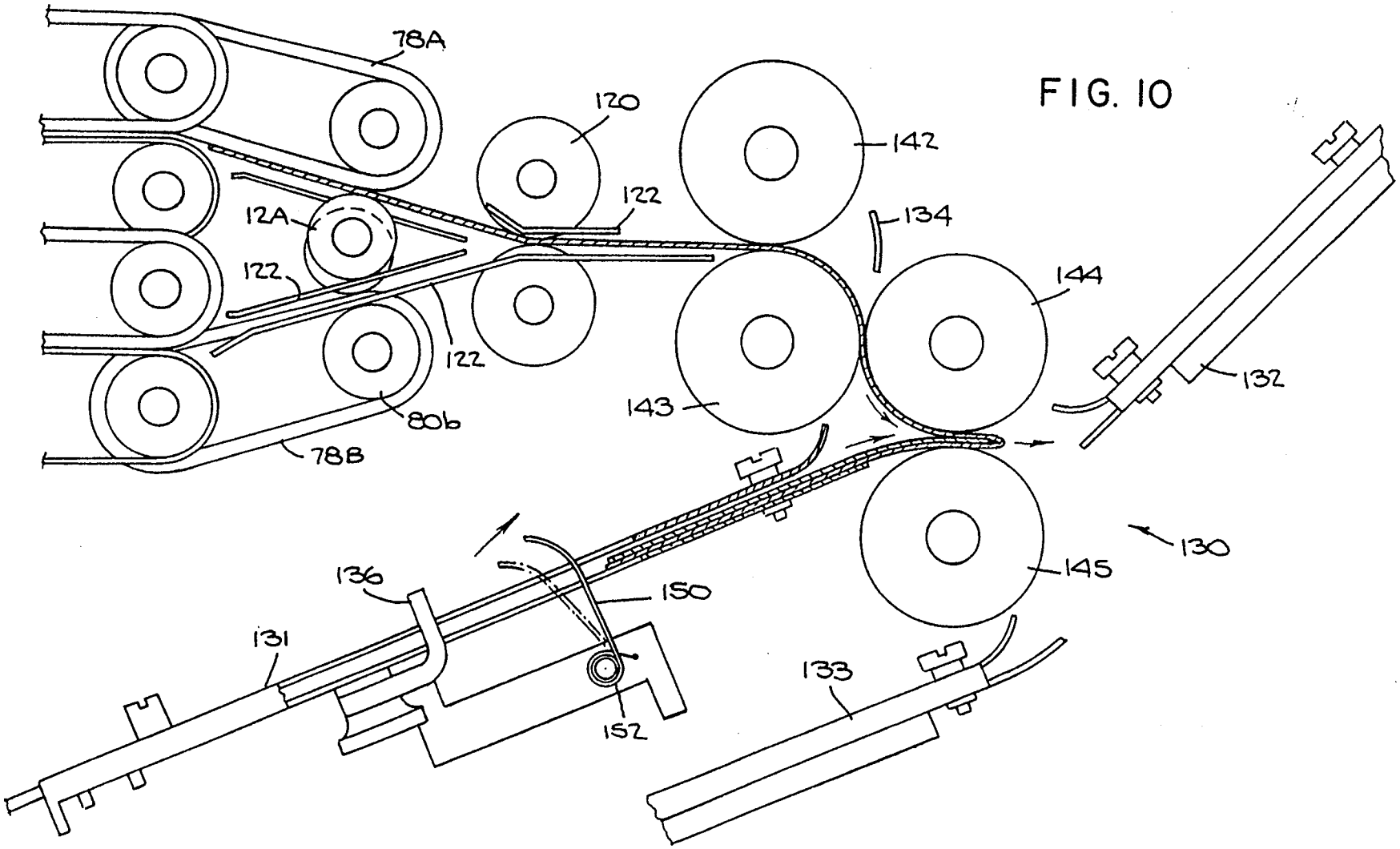
FIG. 10 is similar to FIG. 9 showing the smaller document nested in a first fold of the larger document.

Folder 130 is a conventional six roller folder with three buckle chutes 131, 132 and 133. For the purpose of describing the present invention only the first four rollers 141–145 of folder 130 are shown (FIGS. 9 and 10). A bypass plate 134 is positioned in place of a fourth buckle chute in the folder. In addition to a conventional fold stop 136 that is used in typical buckle chutes, such as in buckle chutes 132 and 133, buckle chute 131 has a spring loaded bounce, generally designated 140, that works in conjunction with but not in place of the fold stop 136 within chute 131. Spring loaded bounce 140 includes a spring loaded kicker 150 and kicker stops (not shown) defining both the forward and back position of kicker 150. The forward or normal position locates kicker 150 in the path of the collation coming into buckle chute 131. The back position limits the deflection of kicker 150 such that it travels just slightly farther than fold stop 136. It has been found that if kicker 150 is allowed to go any farther past stop 136 the reaction time of spring kicker 150 is not fast enough to keep the small document justified to the large document while it is being kicked out of chute 131.

In an alternate embodiment (not shown) of the present invention a brush having stiff brush hairs is used in place of spring kicker 150. The brush hairs are bent in a way that causes the brush hairs to act as springs.

Chute 131 is similar in structure to a typical bouncing buckle chute which is typically used for inverting sheets. The present invention uses the bouncing buckle chute to nest small documents, such as a check, into the fold of the larger documents of the collation.

Having explained the details of the apparatus hereinabove, the manner of operation will now be explained. In accordance with the present invention two different size documents are fed from one or more input devices into accumulator 40 to form a collation of the two different size documents. For example, a dual stage burster (not shown) may feed a full size (8½ by 11) statement from one stage and a smaller size (5 by 2½) check from a second stage. One or more of the smaller documents, which must be nested inside the folded larger documents of the collation, are fed into accumulator 40 first. After the smaller documents have been fed, the larger documents are fed into accumulator 40.

Both size documents fed from the input devices are transported to accumulator 40 by transport 20. The multiple idler rollers 16 opposing the driven flat belts 12 deter any skewing of the documents as they are transported into accumulator For each collation, the smaller documents are fed seriatim from a corresponding upstream feeder (not shown) to transport 20. Then the larger documents of the collation are fed seriatim to transport 20 by their corresponding feeder (not shown). With deflector 46 pivoted to deflect documents to upper pocket 45A (FIG. 2) the small and large documents are conveyed seriatim in the order received to upper pocket 41A by belts 34 and pulley/rollers 22 and 24. The documents are directed into the respective pockets 41A or 41B by deflector 46 located at the entry of accumulator 40. As a document enters accumulator 40, it is in the control of pulley/rollers 22 and 24 which then pass the document into the bite of the accumulation transport system in pocket 41A or 41B which includes two continuously moving, lower flat belts 60 opposed by steel balls 90.

The documents are transported over the first set of guide blocks 91 and over the second set of guide blocks 100 and against exit rollers 70. Upper O-ring belts 50, which are continuously moving, provide additional drive to transport the documents through the accumulator, but the primary function of the of O-ring belts 50 is to slap down the trailing edge of the documents as they pass over ramp sections 93 and 102 of guide blocks 91 and 100 respectively. Exit rollers 70 are clutched on and off as required during the accumulation of documents into a collation. At the completion of a collation, rollers 70 clutched on releasing the collation which is transported into folder 130.

As the first document, i.e., the smaller and nested document, enters accumulator 40, it is transported over both sets of guide blocks 91 and 100 to the output end of accumulator 40 and is stopped with its lead edge at exit rollers 70 and its trail edge settled just past ramp section 102. The larger document is then transported over both sets of guide blocks 91 and 100 stopping when its lead edge hits exit rollers 70 and its trail edge settles just past ramp section 93. At this point, the documents are all justified to the lead edge and accumulated in the proper order. As exit rollers 70 are activated the total collation moves into the bite of the output transport 121 between accumulator 40 and folder 130. Output transport 121 funnels the two accumulator paths back to one paper path and transports the collation into the bite of folder 130.

As a collation containing both large and small document enters folder 130 bypass plate 134 forces the collation by without any alteration to the collation through the fold rollers and into buckle chute 131. Fold stop 136 in chute 131 is set to fold ⅓ of the large document in the chute. This length also allows the small document to be completely inserted into buckle chute 131. As the lead edge of the documents hits stop 136 the fold takes place and the documents begin to exit buckle chute 131. The large documents are being folded and removed by fold pinch rollers 144 and 145. Normally the small document would be partially or totally left behind in buckle chute 131. But in the present invention spring bounce 140 works to complete the nesting of the smaller document into the fold of the larger document (FIG. 10). As the collation enters buckle chute 131, the leading edge of the collation forces a spring kicker 150 to rotate from its normal position (shown in phantom) loading spring 152. As the larger documents of the collation buckle and begin to exit from buckle chute 131, the force of the loaded spring 152 rotates kicker 150 back to its normal position which pushes the smaller document (s) out with the larger documents of the collation. The smaller document(s) is now nested inside the fold of the large documents which now continues into buckle chute 132 to begin a second fold before leaving folder 130 for further processing, for example, in an inserting machine.

In an alternate embodiment (not shown) of the present invention, a normal force is applied to the collation, such that the smaller document is removed from the buckle chute as the larger documents are folder by the folding rollers. For example, a spring or brush mounted in a wall of the buckle chute provides a normal force to the collation.

The preferred embodiment of the present invention has been described for collations having documents of two different sizes. It will be appreciated that further sets of guide blocks can be added to accumulator 40 to form collations having documents of more than two different sizes, wherein the smallest document is accumulated first and the largest document is accumulated last.

In an alternate embodiment (not shown) of the present invention, a normal force is applied to the collation such that the smaller document is removed from the buckle chute as the larger documents are folder by the folding rollers. For example, instead of kicker spring 150, a spring or brush is mounted in a wall of the buckle chute to provide a normal force to the collation as the collation enters and leaves the buckle chute. This normal force arrangement causes the smaller documents to exit the buckle chute with the larger documents.

While the present invention has been disclosed and described with reference to a single embodiment thereof, it will be apparent, as noted above that variations and modifications may be made therein. It is also noted that the present invention is independent of the machine being controlled, and is not limited to the control of inserting machines. It is, thus, intended in the following claims to cover each variation and modification that falls within the true spirit and scope of the present invention.

What is claimed is:

1. A method of forming a collation of at least two different size documents comprising the steps of:

feeding at least one smaller size document into a collating apparatus;

holding said smaller size document in said collating apparatus lead edge justified;

feeding at least one larger size document into said collating apparatus;

holding said larger size document in said collating machine superposed on said smaller document with lead edge justified to form a collation; and feeding said collation out of said collating apparatus lead edge first for further processing while maintaining the justified lead edge of said collation.

2. The method of claim 1 comprising the further step of nesting said smaller document into a first fold of said larger document.

3. Apparatus for accumulating two different size documents to form a collation, comprising:

a first ramp guide block defining an upstream end of a first stacking area for smaller ones of the documents;

a second ramp guide block defining an upstream end of a second stacking area for larger ones of the documents;

means for transporting both the smaller and larger of the documents over said first and second ramp guide blocks; and means for registering the lead edge of both the smaller and larger ones of the documents after said documents have been transported over said first and second ramp guide means.

4. The apparatus of claim 3 wherein said transporting means include at least two lower, endless, flat belts that are laterally spaced a distance approximately equal to tile width of the smaller ones of the documents, said flat belts being opposed from above by a plurality of longitudinally spaced balls that are suspended above each of said flat belts by a housing wherein said longitudinally spaced balls provide a normal force against the smaller and larger ones of said documents being transported over said first and second ramp guide means.

5. The apparatus of claim 4 wherein said transporting means further comprises at least one upper, endless, O-ring belt laterally spaced between said flat belts, said lower flat belts and said upper O-ring belt each having an upper and lower reach, wherein the lower reach of the upper O-ring belt is situated approximately on the horizontal plane of the upper reach of said lower flat belts to thereby frictionally engage both the smaller and larger ones of said documents as said documents are transported over said first and second ramp guide means.

6. Apparatus for accumulating two different size documents to form a collation, comprising:

a first accumulator pocket having first means for individually transporting, stacking and registering at least one smaller one and one larger one of said documents to form a first collation of said smaller and larger documents;

a second accumulator pocket superposed over said first accumulator pocket, said second accumulator pocket having second means for individually transporting, stacking and registering at least one smaller one and one larger one of said documents to form a second collation of said smaller and larger documents; and diverting means situated upstream of said first and second pockets for diverting said smaller and larger documents to one of said first and second accumulator pockets, wherein each of said first and second accumulator pockets includes a first ramp guide block defining an upstream end of a first stacking area for smaller ones of the documents and a second ramp guide block defining an upstream end of a second stacking area for larger ones of the documents.

* * * * *